US011402784B2

(12) United States Patent
Tachi et al.

(10) Patent No.: US 11,402,784 B2
(45) Date of Patent: Aug. 2, 2022

(54) IMAGE FORMING APPARATUS AND IMAGE FORMATION METHOD

(71) Applicants: Masashi Tachi, Kanagawa (JP); Tomohide Takenaka, Kanagawa (JP); Masaki Sukesako, Kanagawa (JP); Keita Sone, Tokyo (JP)

(72) Inventors: Masashi Tachi, Kanagawa (JP); Tomohide Takenaka, Kanagawa (JP); Masaki Sukesako, Kanagawa (JP); Keita Sone, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/222,284

(22) Filed: Apr. 5, 2021

(65) Prior Publication Data

US 2021/0318651 A1 Oct. 14, 2021

(30) Foreign Application Priority Data

Apr. 10, 2020 (JP) ..... JP2020-071108
Jan. 21, 2021 (JP) ..... JP2021-007806

(51) Int. Cl.
*G03G 15/00* (2006.01)

(52) U.S. Cl.
CPC ..... *G03G 15/5062* (2013.01); *G03G 15/5025* (2013.01)

(58) Field of Classification Search
CPC ..... G03G 15/5041; G03G 15/5058
See application file for complete search history.

(56) References Cited

U.S. PATENT DOCUMENTS

| | | | | |
|---|---|---|---|---|
| 7,623,148 | B2 * | 11/2009 | Seki | G03G 15/5033 347/237 |
| 9,188,924 | B2 * | 11/2015 | Kaneko | G03G 15/0849 |
| 9,268,281 | B2 * | 2/2016 | Saito | G03G 15/0856 |
| 10,948,864 | B2 * | 3/2021 | Akatsu | G03G 15/556 |
| 2017/0315471 | A1 | 11/2017 | Kamihara et al. | |
| 2018/0143581 | A1 | 5/2018 | Nakayama et al. | |
| 2018/0150010 | A1 | 5/2018 | Sone et al. | |
| 2019/0064719 | A1 | 2/2019 | Tachi et al. | |
| 2019/0163108 | A1 | 5/2019 | Sakurada et al. | |

FOREIGN PATENT DOCUMENTS

| | | |
|---|---|---|
| JP | 2017-037217 | 2/2017 |
| JP | 2019-101125 | 6/2019 |

* cited by examiner

*Primary Examiner* — Leon W Rhodes, Jr.
(74) *Attorney, Agent, or Firm* — Harness, Dickey & Pierce, P.L.C.

(57) ABSTRACT

An image forming apparatus includes an image forming device, a density deviation detector, and processing circuitry. The circuitry performs a density deviation adjustment mode to: cause the image forming device to form a first image pattern having a uniform image density in the width direction on a surface of an image bearer; cause the detector to detect a first image density deviation in the width direction in the first pattern; adjust the first deviation based on a detection result of the first pattern; cause the image forming device to form a second image pattern on a surface of the image bearer after adjustment of the first deviation; cause the detector to detect a second image density deviation in the width direction in the second pattern; and correct a light intensity sensitivity in adjusting the second deviation, based on a detection result of the second pattern.

7 Claims, 10 Drawing Sheets

IMAGE FORMING APPARATUS AND IMAGE FORMATION METHOD

CROSS-REFERENCE TO RELATED APPLICATIONS

This patent application is based on and claims priority pursuant to 35 U.S.C. § 119(a) to Japanese Patent Application Nos. 2020-071108, filed on Apr. 10, 2020, and 2021-007806, filed on Jan. 21, 2021, in the Japan Patent Office, the entire disclosure of each of which is hereby incorporated by reference herein.

BACKGROUND

Technical Field

Embodiments of the present disclosure relate to an image forming apparatus, such as a copy machine, a printer, a fax, or a multifunction peripheral of a copy machine, a printer, and a fax, and an image formation method performed in the image forming apparatus.

Related Art

A technology has been known of an image forming apparatus, such as a copy machine or a printer, that adjusts image density deviations of an image in a main-scanning direction.

For example, an image forming apparatus forms patterns for correction on a sheet of paper, and determines image density deviations (density unevenness) of the patterns for correction in a main-scanning direction. On the basis of a result of the determination, the image forming apparatus adjusts an exposure power from an exposure unit (exposure device) for an uneven density position.

SUMMARY

In an aspect of the present disclosure, there is provided an image forming apparatus that includes an image forming device, a density deviation detector, and processing circuitry. The image forming device is configured to form an image on a surface of an image bearer conveyed in a conveyance direction. The density deviation detector is configured to detect an image density deviation in a width direction perpendicular to the conveyance direction in the image on the surface of the image bearer. The processing circuitry is configured to adjust an image density deviation in the width direction in an image formed by the image forming device. The processing circuitry is configured to perform a density deviation adjustment mode to: cause the image forming device to form a first image pattern having a uniform image density in the width direction on a surface of the image bearer; cause the density deviation detector to detect a first image density deviation in the width direction in the first image pattern; adjust the first image density deviation in the width direction, based on a detection result of the first image pattern; cause the image forming device to form a second image pattern on a surface of the image bearer after adjustment of the first image density deviation; cause the density deviation detector to detect a second image density deviation in the width direction in the second image pattern; and correct a light intensity sensitivity in adjusting the second image density deviation in the width direction, based on a detection result of the second image pattern.

In another aspect of the present disclosure, there is provided an image formation method that includes: forming a first image pattern having a uniform image density in a width direction; first detecting a first image density deviation in the width direction in the first image pattern; adjusting the first image density deviation in the width direction based on a detection result of the first detecting; forming a second image pattern having a uniform image density in the width direction; second detecting a second image density deviation in the width direction in the second image pattern; and correcting a light intensity sensitivity in adjusting the second image density deviation in the width direction, based on a detection result of the second detecting.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
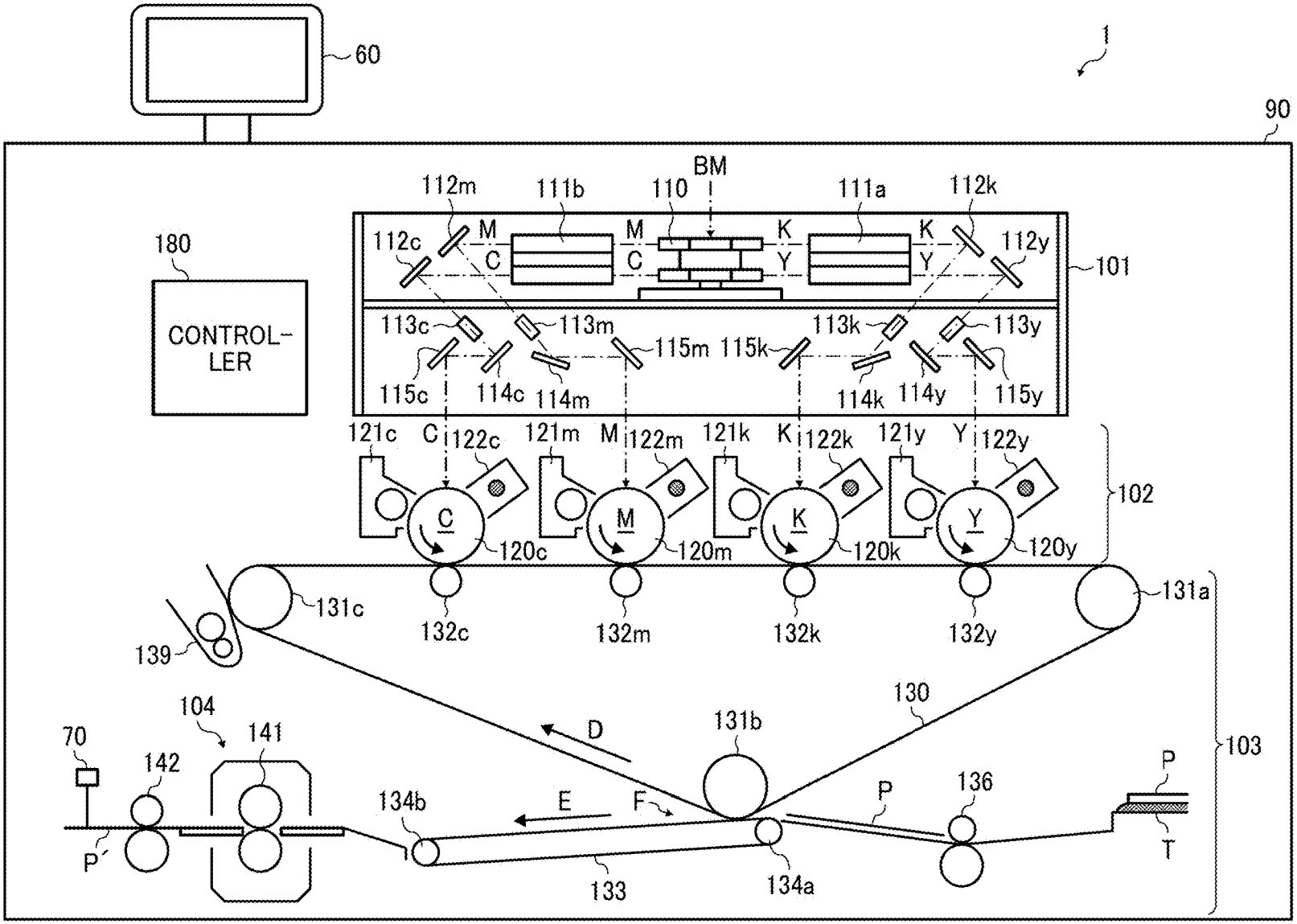
FIG. 1 is a schematic view illustrating an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to the drawings, embodiments of the present disclosure are described below. Note that identical parts are given identical reference numerals and redundant descriptions are summarized or omitted accordingly.

Initially with reference to FIG. 1, a configuration and operation of an image forming apparatus 1 according to an embodiment of the present disclosure is described below.

The image forming apparatus 1 according to the present embodiment is a color printer. The image forming apparatus 1 according to the present embodiment contains an exposure device 101, an image formation device 102, a transfer device 103, a fixing device 104, a linear sensor 70 (density sensor) as a density deviation detector in a housing 90 of the image forming apparatus 1. The image forming apparatus 1 according to the present embodiment also includes an operation panel 60 on a top of the housing 90. The operation panel 60 is an operation device. The exposure device 101, the image formation device 102, the transfer device 103, and the like constitute a printer engine 100. In the present embodiment, the printer engine 100 functions as an image forming device that forms an image on a sheet P as an image bearer.

The image formation device 102 includes four photoconductors (a photoconductor 120*y* for yellow (Y), a photoconductor 120*k* for black (K), a photoconductor 120*m* for magenta (M), and a photoconductor 120*c* for cyan (C)). The four photoconductors 120*y*, 120*k*, 120*m*, and 120*c* are aligned and are opposite an intermediate transfer belt 130.

Developing devices 121*y*, 121*k*, 121*m*, and 121*c*, charging devices 122*y*, 122*k*, 122*m*, and 122*c*, cleaners, discharging devices, and the like are disposed around the photoconductors 120*y*, 120*k*, 120*m*, and 120*c*, respectively.

The transfer device 103 includes the intermediate transfer belt 130 and a secondary transfer belt 133.

The fixing device 104 includes a fixing roller 141, a pressing roller pressed against the fixing roller 141, and a discharging roller 142.

With reference to FIG. 1, operations of the image forming apparatus 1 at a time of a normal image formation operation are described below.

First, the exposure device 101 irradiates surfaces of the photoconductors 120*y* to 120*c* of the image formation device 102 with exposure light beams to form latent images on the photoconductors 120*y* to 120*c*. The latent images correspond to image data (a desired image). That is to say, the exposure device 101 selectively irradiates a writing position that corresponds to an image pattern of image data with an exposure light beam that has a writing light intensity (an output of the exposure light beam) that corresponds to an image density. A light beam emitted from a laser light source or a light emitting diode (LED) light source, or the like can be used as the exposure light beam. Exposure light beams BM emitted from light sources are deflected by a polygon mirror 110, and enter scanning lenses 111*a* and 111*b*. The scanning lenses 111*a* and 111*b* each include fθ lens. Operations that emit exposure light beams from the light sources are described in detail below.

Exposure light beams that correspond to images of colors of yellow (Y), black (K), magenta (M), and cyan (C), respectively, are emitted, and pass the scanning lenses 111*a* and 111*b*. Then the emitted exposure light beams are reflected by reflection mirrors 112*y* to 112*c*.

More specifically, an exposure light beam Y for yellow passes the scanning lens 111*a*, is reflected by the reflection mirror 112*y*, and enters a WTL lens 113*y*. Exposure light beams K, M, and C for colors of black, magenta, and cyan proceed in a similar way.

The WTL lenses 113*y* to 113*c* shape exposure light beams Y, K, M, and C that enter the WTL lenses 113*y* to 113*c*. Then the WTL lenses 113*y* to 113*c* deflect the exposure light beams Y, K, M, and C to reflection mirrors 114*y* to 114*c*. Then the exposure light beams Y, K, M, and C are also reflected by reflection mirrors 115*y* to 115*c*, and are emitted onto surfaces of the photoconductors 120*y*, 120*k*, 120*m*, and 120*c*.

Timings at which the photoconductors 120*y*, 120*k*, 120*m*, and 120*c* are irradiated with exposure light beams Y, K, M, and C are synchronized relative to a main-scanning direction and a sub-scanning direction relative to the photoconductors 120*y*, 120*k*, 120*m*, and 120*c*. In the present embodiment, the photoconductors 120*y*, 120*k*, 120*m*, and 120*c* are drum-shaped members (photoconductor drums) that rotate in a counterclockwise direction in FIG. 1. Directions of axes of the rotation are the main-scanning direction.

The main-scanning direction relative to the photoconductors 120*y*, 120*k*, 120*m*, and 120*c* is defined as a scanning direction of an exposure light beam. The sub-scanning direction is defined as a direction perpendicular to the main-scanning direction (the sub-scanning direction is a direction in which the photoconductors 120*y*, 120*k*, 120*m*, and 120*c* rotate, and is a direction perpendicular to directions of axes of the rotation. That is to say, a direction that is perpendicular to a surface of FIG. 1 is the "main-scanning direction".

Figure 3:
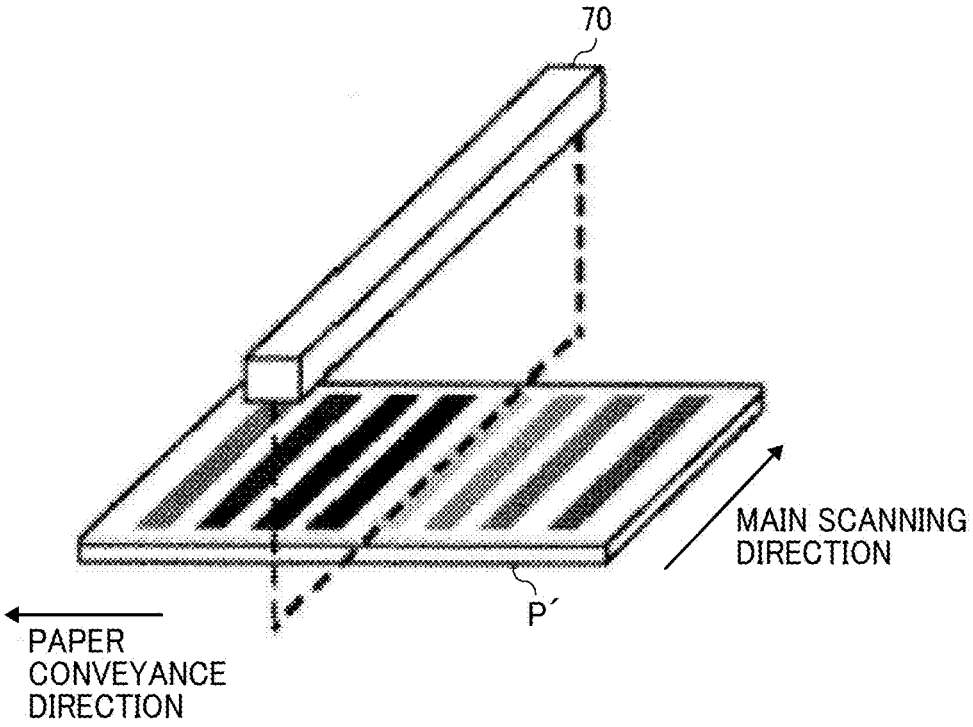
FIG. 3 is a schematic perspective view illustrating a linear sensor and a sheet on which shade image patterns are formed.

In other words, a sheet P as an image bearer is conveyed in a predetermined conveyance direction (a "paper conveyance direction" in FIG. 3). Therefore, the "main-scanning direction" of a sheet P is a "width direction" perpendicular to a conveyance direction of the sheet P. The "sub-scanning direction" of a sheet P is a "conveyance direction" of the sheet P.

The photoconductors 120*y*, 120*k*, 120*m*, and 120*c* include a conductive drum, such as aluminum, and photoconductive layers on the conductive drum. The photoconductive layers include a charge generation layer and a charge transportation layer.

Surfaces of the photoconductors 120*y*, 120*k*, 120*m*, and 120*c* are charged by the charging devices 122*y*, 122*k*, 122*m*, and 122*c*. Then the surfaces of the photoconductors 120*y*, 120*k*, 120*m*, and 120*c* are irradiated with exposure light beams to form electrostatic latent images.

Then the electrostatic latent images on the surfaces of the photoconductors 120*y*, 120*k*, 120*m*, and 120*c* are developed by the developing devices 121*y*, 121*k*, 121*m*, and 121*c* to form images (toner images).

Images on the surfaces of the photoconductors 120*y*, 120*k*, 120*m*, and 120*c* are superimposed on the intermediate transfer belt 130 at positions of primary transfer rollers 132*y*, 132*k*, 132*m*, and 132*c* to perform primary transfer. The intermediate transfer belt 130 is moved by conveyance rollers 131*a* to 131*c* in a direction of an arrow D. Consequently, a color image is formed on the intermediate transfer belt 130.

The color image on the intermediate transfer belt 130 moves to a secondary transfer position F (where the intermediate transfer belt 130 and the secondary transfer belt 133 are pressed against each other). The secondary transfer belt 133 is stretched and supported by conveyance rollers 134*a* and 134*b*. Rotation of the conveyance rollers 134*a* and 134*b* moves the secondary transfer belt 133 in a direction of an arrow E.

A conveyance roller 135 feeds a sheet P, such as paper, to the secondary transfer position F from a sheet container T, such as a sheet feeding cassette. A secondary transfer bias is applied at the secondary transfer position F to perform a secondary transfer that transfers an image borne on the intermediate transfer belt 130 to a sheet P attracted onto and supported on the secondary transfer belt 133. The intermediate transfer belt 130 that has passed the secondary transfer position F reaches a position of a cleaner 139. At the position, untransferred toner that remains on the intermediate transfer belt 130 is removed.

Then the secondary transfer belt 133 conveys the sheet P to the fixing device 104. The fixing device 104 presses and heats an image transferred onto the sheet P by the secondary transfer (unfixed image) to fix the image. The sheet P onto which the image is fixed, as a sheet P' after image formation, is discharged from the fixing device 104 by the discharging roller 142. Then the sheet P' discharged from the fixing device 104 passes a position of the linear sensor 70. Then the sheet P' as an output image is discharged out of the image forming apparatus 1. Consequently, the image forming apparatus 1 completes a series of an image formation process.

In the present embodiment, the linear sensor 70 is disposed downstream of the fixing device 104. The linear sensor 70 is a density deviation detector that detects an image density deviation in the main-scanning direction in an image on a surface of a sheet P' (an image bearer). On the basis of a result of detection by the linear sensor 70, an image density deviation (density unevenness) in the main-scanning direction is corrected. The correction is described in detail below.

In the present embodiment, a rotation direction of the photoconductors 120*y*, 120*k*, 120*m*, and 120*c*, a conveyance direction of the intermediate transfer belt 130, and a conveyance direction of a sheet P or P' each perpendicularly crosses the main-scanning direction, and are each the same as the sub-scanning direction.

Figure 2:
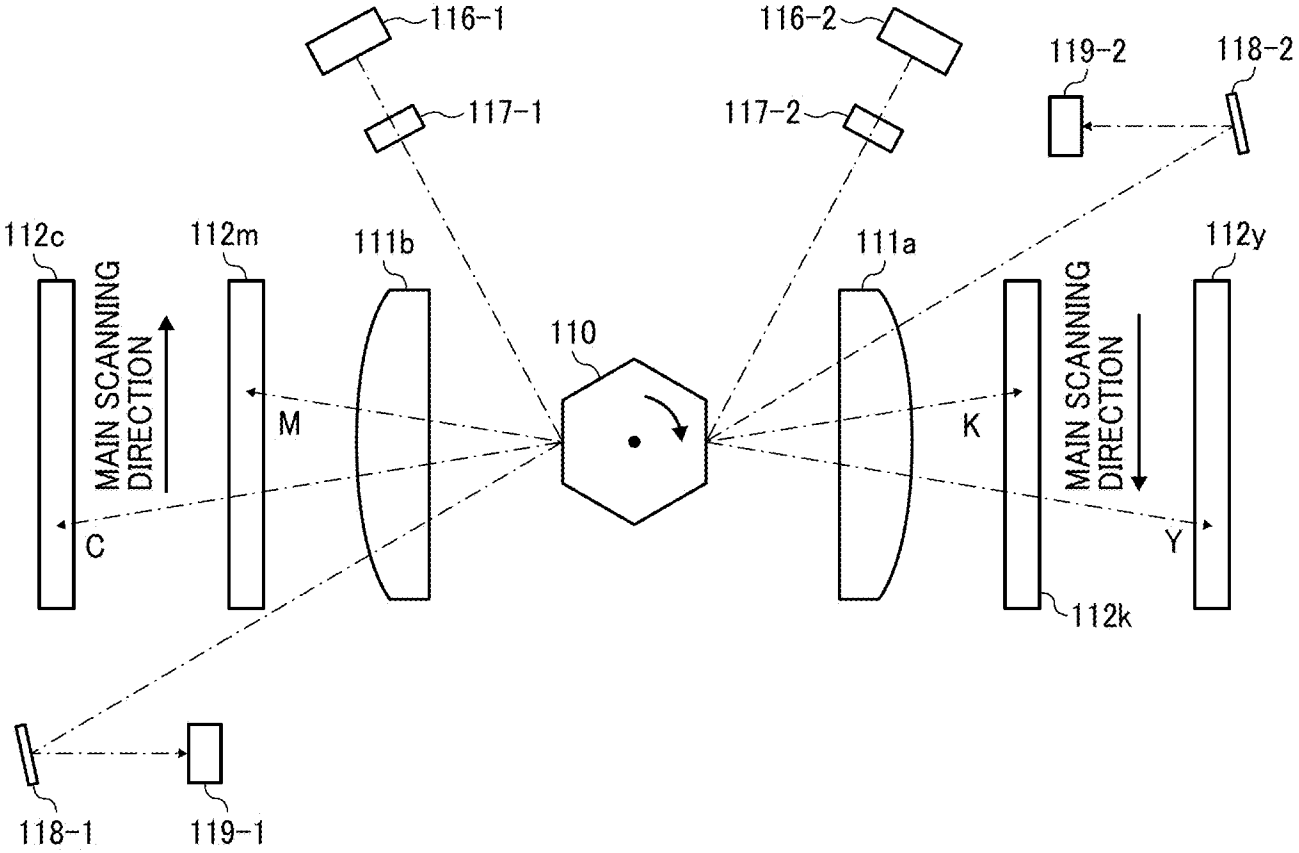
FIG. 2 is a schematic view illustrating an exposure device.

With reference to FIG. 2, a configuration of the exposure device 101 that has been described with reference to FIG. 1, and light paths of exposure light beams BM are described in detail below.

As illustrated in FIG. 2, the exposure device 101 includes two laser diode (LD) units 116-1 and 116-2 as light sources. The two LD units 116-1 and 116-2 each include a laser element. The laser element is driven to selectively irradiate a writing position (exposure position) that corresponds to image data with an exposure light beam that has an exposure light intensity that corresponds to the image data.

An exposure light beam emitted from the first LD unit 116-1 passes a cylindrical lens 117-1, and enters the polygon mirror 110 rotated by a polygon motor. The LD unit 116-1 includes an upper LD and a lower LD. The upper LD emits an exposure light beam for magenta. The exposure light beam for magenta enters an upper surface of the polygon mirror 110. The lower LD emits an exposure light beam for cyan. The exposure light beam for cyan enters a lower surface of the polygon mirror 110.

The exposure light beam for magenta that has entered the upper surface of the polygon mirror 110 is deflected by rotation of the polygon mirror 110. The exposure light beam that has been deflected passes the scanning lens 111*b*, and enters the reflection mirror 112*m*. Then the exposure light beam for magenta scans a surface of the photoconductor 120*m* for magenta.

The exposure light beam for cyan that has entered the lower surface of the polygon mirror 110 is deflected by rotation of the polygon mirror 110. The exposure light beam for cyan that has been deflected passes the scanning lens 111*b*, and enters the reflection mirror 112*c*. Then the exposure light beam for cyan scans a surface of the photoconductor 120*c* for cyan.

A synchronizing mirror 118-1 and a synchronizing sensor 119-1 are disposed at an end on a writing start side in the main-scanning direction. The end on a writing start side in the main-scanning direction is in front of an image writing start position in an image non-writing area in the main-scanning direction. An exposure light beam for magenta and an exposure light beam for cyan that have passed the scanning lens 111*b* are reflected by the synchronizing mirror 118-1, and enter the synchronizing sensor 119-1. Due to the exposure light beam for magenta and the exposure light beam for cyan entering the synchronizing sensor 119-1, the synchronizing sensor 119-1 outputs synchronicity detection signals used to determine writing start timings of main scanning with the exposure light beam for magenta and the exposure light beam for cyan.

Similarly, an exposure light beam emitted from the second LD unit 116-2 passes a cylindrical lens 117-2, and enters the polygon mirror 110 rotated by the polygon motor. The LD unit 116-2 also includes an upper LD and a lower LD. The upper LD emits an exposure light beam for black. The exposure light beam for black enters an upper surface of the polygon mirror 110. The lower LD emits an exposure light beam for yellow. The exposure light beam for yellow enters a lower surface of the polygon mirror 110.

The exposure light beam for black that has entered the upper surface of the polygon mirror 110 is deflected by rotation of the polygon mirror 110. The exposure light beam for black that has been deflected passes the scanning lens 111*a*, and enters the reflection mirror 112*k*. Then the exposure light beam for black scans a surface of the photoconductor 120*k* for black.

The exposure light beam for yellow that has entered the lower surface of the polygon mirror 110 is deflected by rotation of the polygon mirror 110. The exposure light beam for yellow that has been deflected passes the scanning lens 111*a*, and enters the reflection mirror 112*y*. Then the exposure light beam for yellow scans a surface of the photoconductor 120*y* for yellow.

A synchronizing mirror 118-2 and a synchronizing sensor 119-2 are disposed at an end on a writing start side in the main-scanning direction. The end on a writing start side in the main-scanning direction is in front of an image writing start position in an image non-writing area in the main-scanning direction. An exposure light beam for black and an exposure light beam for yellow that have passed the scanning lens 111*a* are reflected by the synchronizing mirror 118-2, and enter the synchronizing sensor 119-2. Due to the exposure light beam for black and the exposure light beam for yellow entering the synchronizing sensor 119-2, the synchronizing sensor 119-2 outputs synchronicity detection signals used to determine writing start timings of main scanning with the colors.

Figure 4:
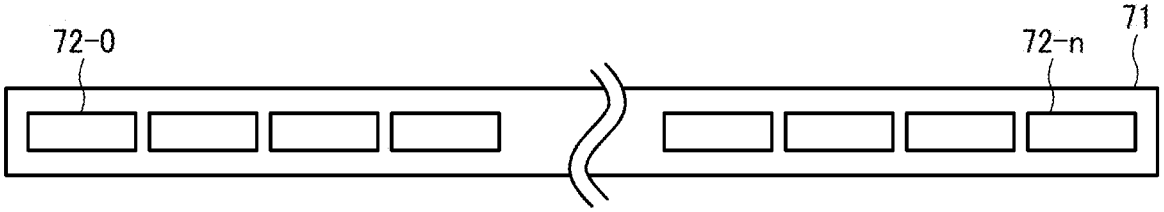
FIG. 4 is a schematic view illustrating the linear sensor in a main-scanning direction.
Figure 5:
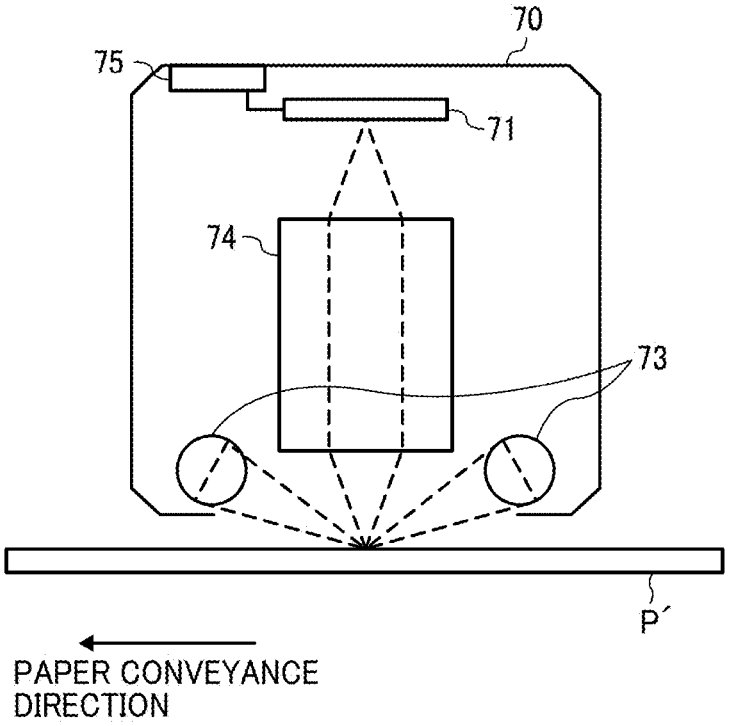
FIG. 5 is a schematic view illustrating the linear sensor.

With reference to FIGS. 3 to 5, a configuration of the linear sensor 70 (density deviation detector) is described below.

As illustrated in FIGS. 3 and 4, the linear sensor 70 is disposed in such a manner that a lengthways direction of the linear sensor 70 extends in the main-scanning direction. The linear sensor 70 includes an image element 71 that extends in the lengthways direction (main-scanning direction). The image element 71 includes a plurality of light receiving elements 72-0 to 72-*n* aligned in the lengthways direction. A range within which the plurality of light receiving elements 72-0 to 72-*n* is aligned is a range of detection by the linear sensor 70 in the main-scanning direction. A range of detection by the linear sensor 70 is a range in the main-scanning direction represented with a broken line in FIG. 3. The linear sensor 70 detects image densities of a whole area of a sheet P' (paper) conveyed in a predetermined conveyance direction (sub-scanning direction).

In the present embodiment, the linear sensor 70 functions as a density deviation detector that detects an image density deviation in the main-scanning direction in an image on a sheet P'. Therefore, the density deviation detector is not limited to what can detect image densities across the main-scanning direction, such as the linear sensor 70, but may detect image densities at a plurality of positions (for example, three positions of both ends and the center) in the main-scanning direction. Alternatively, a density deviation detector may include density sensors disposed at ends in the main-scanning direction, respectively. Further, image densities in a central area where image densities are not directly detected may be approximated with a method, such as linear interpolation.

In addition to the image element 71, the linear sensor 70 includes a light source 73, a lens array 74, and an output circuit 75, as illustrated in FIG. 5. In FIG. 5, broken lines represent light emitted from the light source 73.

As the light source 73, a light emitting element disposed at an end of a photoconductive member, an LED array, or the like can be used. The light source 73 emits light of red, green, and blue (RGB). As the lens array 74, a SELFOC (registered trademark) lens or the like can be used.

Light emitted from the light source 73 is reflected on a sheet P', and is focused by the lens array 74. The image element 71 uses the light receiving elements 72 illustrated in FIG. 4 to receive light focused by the lens array 74, and outputs a signal that corresponds to the received light. As the image element 71, a complementary metal-oxide-semiconductor (CMOS) sensor, a charge-coupled device (CCD) sensor, or the like can be used.

As the output circuit 75, an application specific integrated circuit (ASIC) can be used, for example. The output circuit 75 converts signals output from the light receiving elements 72 on the image element 71 into data that indicates image densities that correspond to positions in the main-scanning direction on a sheet P'. For example, the output circuit 75 outputs zero to 255 shades represented with eight bits.

Figure 6:
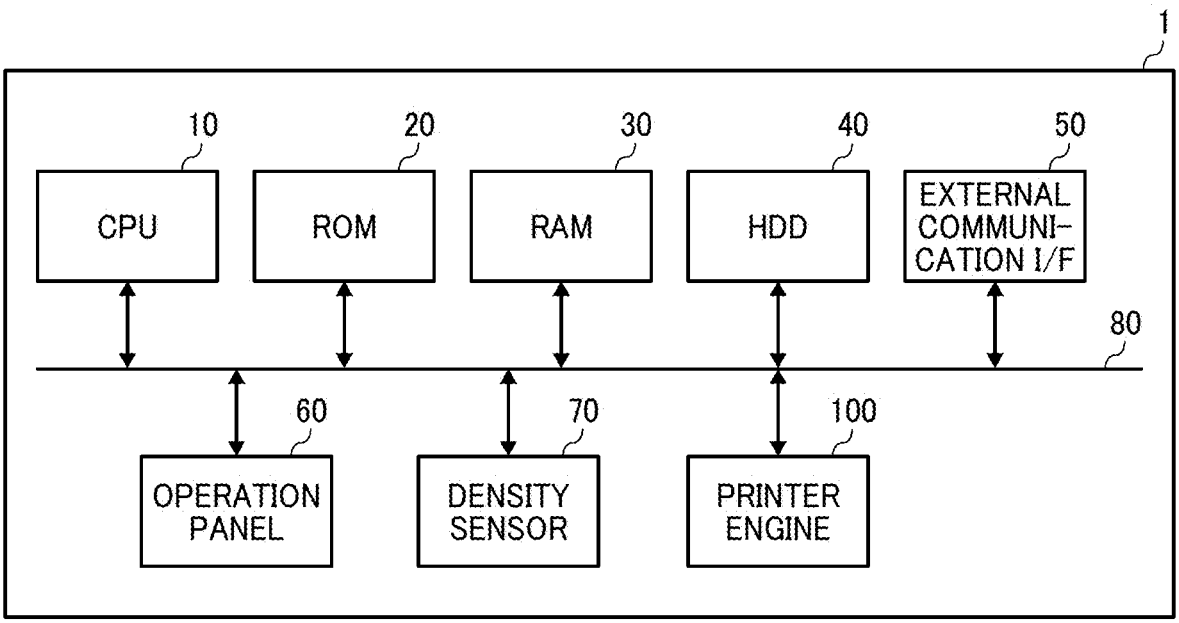
FIG. 6 is a block diagram illustrating hardware of the image forming apparatus.

With reference to FIG. 6, a configuration of hardware of the image forming apparatus 1 is described below.

As illustrated in FIG. 6, the image forming apparatus 1 includes a central processing unit (CPU) 10, a read-only memory (ROM) 20, a random-access memory (RAM) 30, a hard disk drive (HDD) 40, an external communication interface (I/F) 50, the operation panel 60 (operation device), the linear sensor 70 (density sensor), and the printer engine 100. The image forming apparatus 1 also includes a system bus 80 that couples the CPU 10, the ROM 20, the RAM 30, the HDD 40, the external communication I/F 50, the operation panel 60 (operation device), the linear sensor 70 (density sensor), and the printer engine 100 to each other.

The CPU 10 controls operations of the image forming apparatus 1. That is to say, the CPU 10 uses the RAM 30 as a working area to run a program stored in the ROM 20 or the HDD 40. Consequently, the CPU 10 controls operations of the whole image forming apparatus 1, and implements various functions, such as a printer function described above (or a copying function, a scanner function, or a fax function).

The ROM 20 is a nonvolatile semiconductor memory that can retain data even when a power source is turned off. The RAM 30 is a volatile semiconductor memory that temporarily stores a program or data.

The HDD 40 is a nonvolatile memory that stores programs or data. The programs or data stored in the HDD 40 includes an operating system (OS) that is basic software that controls the whole image forming apparatus 1, various application programs that run on the OS, and operation conditions of various functions, such as the copying function described above. Every time the various functions perform functions (jobs), the functions (jobs) may memorize operations of the image forming apparatus 1, and the like.

The external communication I/F 50 connects the image forming apparatus 1 to networks, such as the Internet and a local area network (LAN). The image forming apparatus 1 can receive a print instruction, image data, and the like from external devices via the external communication I/F 50.

The operation panel 60 as an operation device receives various input that corresponds to operation of a user. The operation panel 60 as an operation device also displays various information (for example, information that represents received operation, information that represents an operation state of the image forming apparatus 1, a setting state of the image forming apparatus 1). As the operation panel 60, a liquid crystal display (LCD) that includes a touch screen function may be used. The operation panel 60 may include an operation device, such as hardware keys, and a display, such as a lamp. The printer engine 100 is an image forming device controlled by the CPU 10.

The printer engine 100 is hardware used to implement the printer function and the like.

Programs stored in the ROM 20 or the HDD 40 are programs that can be dealt with by a computer. Programs may be installed in the ROM 20 and the HDD 40 at a time of manufacture or shipping of the image forming apparatus 1. Alternatively, programs may be installed in the ROM 20 and the HDD 40 after sales of the image forming apparatus 1.

With reference to a function block diagram of FIG. 7, the image forming apparatus 1 is described below.

Figure 7:
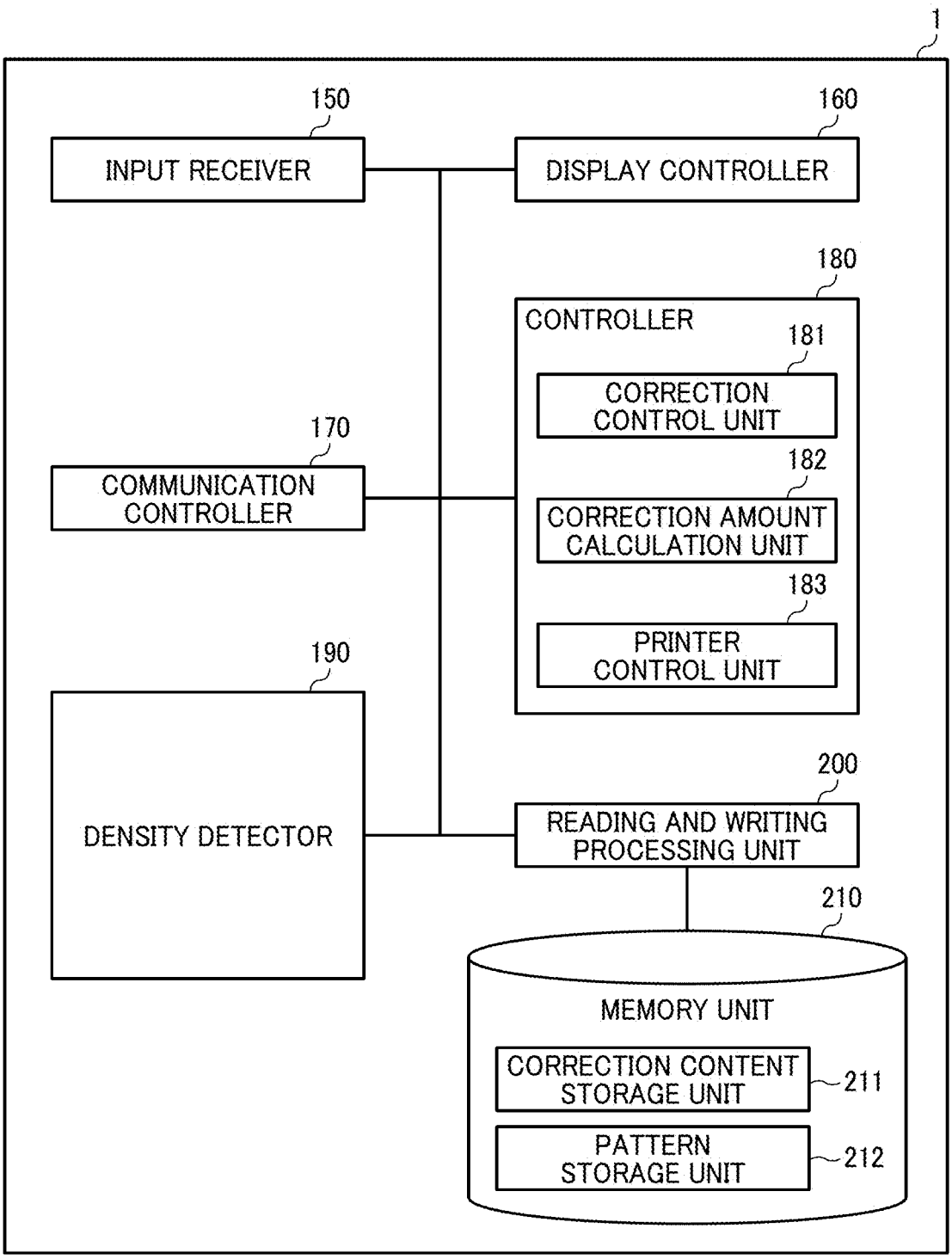
FIG. 7 is a block diagram illustrating functions of the image forming apparatus.

As illustrated in FIG. 7, an input receiver 150 is implemented by the operation panel 60, and performs a function of displaying information necessary for operation, to a user, and a function of receiving various input by a user. The input receiver 150 is also implemented by processing by the external communication I/F 50, and performs a function of receiving a printing instruction or a setting change by a user input from an external device through a LAN or the Internet.

A display controller 160 is implemented by the CPU 10 using the RAM 30 as a working area to run a program stored in the ROM 20 or the HDD 40, and performs a function of controlling a display displayed on the input receiver 150.

A communication controller 170 is implemented by processing by the external communication I/F 50, and performs a function of communicating with external devices through a network if image information can be sent outside with a mail, or if various setting information can be set from external devices.

A controller 180 is implemented by the CPU 10 using the RAM 30 as a working area to run a program stored in the ROM 20 or the HDD 40, and performs functions of the whole image forming apparatus 1.

The controller 180 includes a correction control unit 181, a correction amount calculation unit 182, and a printer control unit 183. The correction control unit 181 performs a function of controlling density unevenness correction in the printer function. The correction amount calculation unit 182 performs a function of calculating a correction amount of an image formation condition used to correct density unevenness. The printer control unit 183 especially performs a function of controlling the printer engine 100. The controller 180 functions as an adjuster that adjusts an image density deviation in the main-scanning direction, and performs a "density deviation adjustment mode" at a predetermined timing. The detail is described below.

A density detector 190 is implemented by the linear sensor 70. The density detector 190 performs a function of detecting density of a shade image pattern formed by the printer engine 100, and a function of outputting a result of the detection.

A reading and writing processing unit 200 is implemented by the CPU 10 using the RAM 30 as a working area to run a program stored in the ROM 20 or the HDD 40. The reading and writing processing unit 200 performs a function of storing various data in a memory unit 210 and a function of reading various data that has been stored.

The memory unit 210 is performed by processing by the ROM 20 or the HDD 40. The memory unit 210 performs a function of storing programs and document data, image formation conditions and various setting information that are necessary for operations of the image forming apparatus 1, an operation log of the image forming apparatus 1, and the like. The image formation conditions include, for example, charging biases, developing biases, exposure light intensities (writing light intensities), and transfer biases.

Various information stored in the memory unit 210 may be set before shipment of the image forming apparatus 1, or may be updated after sales of the image forming apparatus 1. Depending on information to be stored, the memory unit 210 may be performed by a temporary storage function of the RAM 30.

The memory unit 210 includes a correction content storage unit 211 and a pattern storage unit 212. The correction content storage unit 211 performs a function of storing correction contents of the various image formation conditions.

Figure 8:
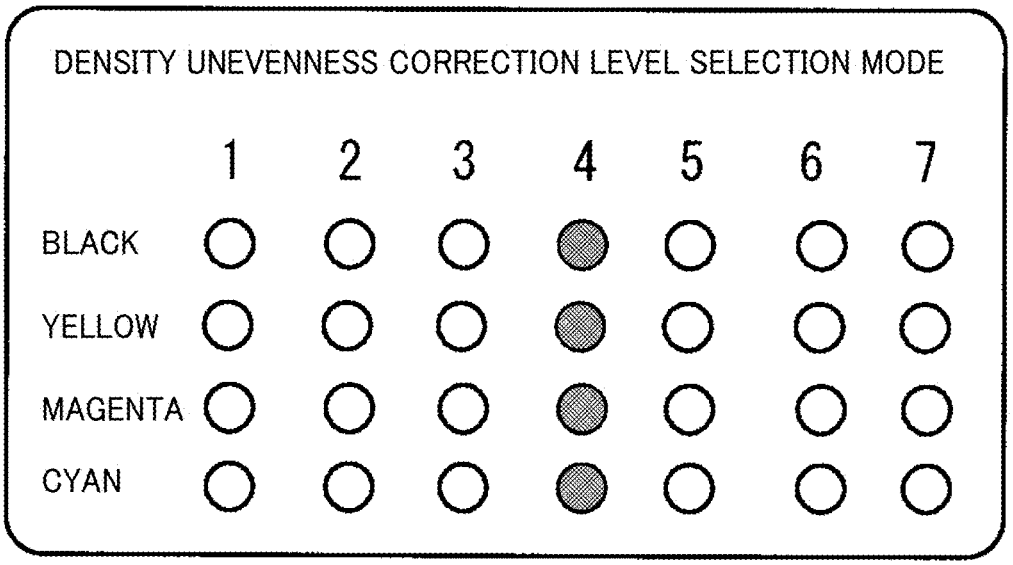
FIG. 8 is a diagram illustrating a display of an operation panel at a time when a density deviation adjustment mode is performed.

FIG. 8 illustrates an operation display used when an operator, such as a user or a serviceman, manually adjusts (corrects) density deviations in the main-scanning direction in an image.

The image forming apparatus 1 according to the present embodiment not only has a "density deviation adjustment mode" that automatically adjusts density deviations in the main-scanning direction in an image, but also may be manually operated by a user to adjust density deviations in the main-scanning direction in an image. The "density deviation adjustment mode" is described below. Similarly as the "density deviation adjustment mode" described below, the manual operation is performed independently of a usual image formation operation (printing operation).

First, a user opens a display for a "density unevenness correction level selection mode" (see FIG. 8) in the operation panel 60 to correct density deviations (density unevenness) in the main-scanning direction in an output image. Then the user selects a desired correction level (standard image density) for each of colors of yellow (Y), magenta (M), cyan (C), and black (K) in the display. In the example in FIG. 8, a level four is selected for each of the colors from levels one to seven. The image density increases in order of levels one to seven.

If the operation panel 60 is manually operated to give instructions on density unevenness correction, as described above, procedure in FIGS. 9A to 9G described below is followed to perform control (density deviation adjustment mode) to correct density deviations in the main-scanning direction. That is to say, the density deviation adjustment mode is performed to form even image densities of each of colors selected by an operator.

With reference to FIGS. 9A to 9G to 11 and the like, a characteristic configuration and operation of the image forming apparatus 1 according to the present embodiment are described in detail below.

The image forming apparatus 1 according to the present embodiment allows the "density deviation adjustment mode" to be performed at a predetermined timing. Consequently, the image forming apparatus 1 automatically selects density correction levels (standard image densities) that are manually selected in the above description with reference to FIG. 8 to adjust density deviations in the main-scanning direction in an output image.

First, the image forming apparatus 1 includes the printer engine 100 as an image forming device, the linear sensor 70 as a density deviation detector, and the controller 180 as an adjuster, as described above with reference to FIG. 1 and the like.

The printer engine 100 as the image forming device forms an image on a sheet P as an image bearer. The printer engine 100 includes the exposure device 101, the image formation device 102, and the transfer device 103.

The linear sensor 70 as a density deviation detector detects an image density deviation in the main-scanning direction in an image on a surface of a sheet P' (image bearer). The linear sensor 70 is disposed in a conveyance path through which a sheet P that has passed the image forming device is conveyed (is disposed downstream of the fixing device 104 in the present embodiment). The linear sensor 70 is opposite a sheet P, and extends in the main-scanning direction.

The controller 180 as an adjuster adjusts image density deviations in the main-scanning direction in an image formed by the printer engine 100 (image forming device).

More specifically, the printer engine 100 (image forming device) includes the exposure device 101. The exposure device 101 irradiates surfaces of the photoconductors 120*y*, 120*k*, 120*m*, and 120*c* that rotate in a predetermined direction with exposure light beams across the main-scanning direction to form latent images that correspond to a desired image. Control by the controller 180 (adjuster) adjusts a light intensity (laser power) of an exposure light beam emitted from the exposure device 101, for each of a plurality of areas divided in the main-scanning direction. A light intensity (output) of an exposure light beam emitted onto a surface of each of the photoconductors 120*y*, 120*k*, 120*m*, and 120*c* is optimized for each of the plurality of areas divided in the main-scanning direction. Consequently, an exposure potential (latent-image potential) on a surface of each of the photoconductors 120*y*, 120*k*, 120*m*, and 120*c* is optimized for each of the areas. Consequently, an image density is made uniform across the main-scanning direction.

The image forming apparatus 1 according to the present embodiment can perform the "density deviation adjustment mode".

Figure 9A:
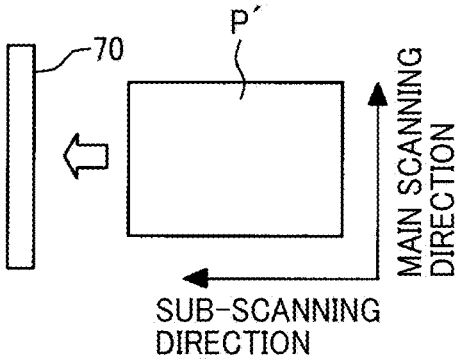
FIGS. 9A to 9G are graphs illustrating transition at a time of a density deviation adjustment mode.

As illustrated in FIG. 9A, if the "density deviation adjustment mode" is performed, first, the printer engine 100 (image forming device) forms shade image patterns PY, PK, PM, and PC (see FIG. 10) on a surface of a sheet P' (image bearer). The shade image patterns PY, PK, PM, and PC each have a uniform image density in the main-scanning direction (that is perpendicular to a conveyance direction of a sheet P and is a "width direction").

Figure 10:
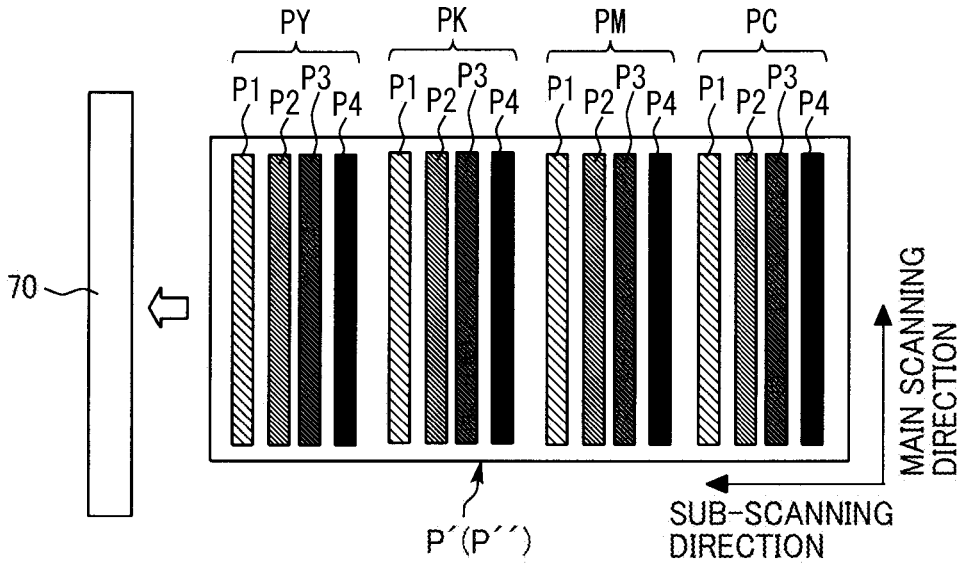
FIG. 10 is a schematic top view illustrating the linear sensor and a sheet on which shade image patterns are formed.

More specifically, as illustrated in FIG. 10, the shade image patterns PY, PK, PM, and PC each have a uniform image density in the main-scanning direction (width direction), and each have different image densities that are stepwise different in the sub-scanning direction (that is a conveyance direction of a sheet P). More specifically, as illustrated in FIG. 10, in the present embodiment, the shade image pattern PY formed with yellow, the shade image pattern PK formed with black, the shade image pattern PM formed with magenta, and the shade image pattern PC formed with cyan are formed on one sheet P' (adjustment sheet) at a timing that is different from a normal image formation operation (for example, at warm-up). The four-color shade image patterns PY, PK, PM, and PC each include four belt-shaped patterns (shade portions P1 to P4). The four belt-shaped patterns (shade portions P1 to P4) have image densities (image area ratios) that are uniform in the main-scanning direction (width direction). Gaps are formed between the four belt-shaped patterns (shade portions P1 to P4) in the sub-scanning direction (conveyance direction). The shade portions P1 to P4 have stepwise different image densities (image area ratios). More specifically, the image densities (image area ratios) increase from 20%, 40%, 70%, to 100% in order of P1, P2, P3, and P4.

In the present embodiment, the four-color shade image patterns PY, PK, PM, and PC are formed on one sheet P. However, a one-color shade pattern may be formed on one sheet P. In the present embodiment, the four-level shade portions P1 to P4 are formed in a shade image pattern. However, the number of shade portions is not limited to four.

In the present embodiment, image densities (image area ratios) of the four shade portions P1 to P4 in a shade image pattern are set to 20%, 40%, 70%, and 100%, respectively. However, image densities (image area ratios) of the shade portions P1 to P4 are not limited to the values, but may be set to optimum values according to usage circumstances and the like.

Figure 9B:
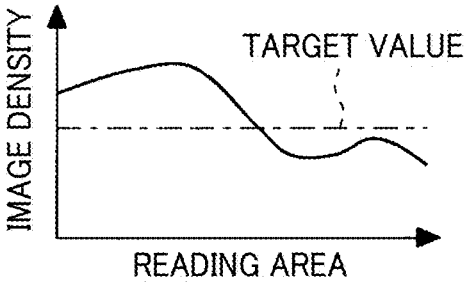

In the "density deviation adjustment mode", next, the linear sensor 70 (density deviation detector) detects image density deviations in the main-scanning direction (width direction) in the shade image patterns PY, PK, PM, and PC (image patterns), as illustrated in FIG. 9B (first detection step).

More specifically, the linear sensor 70 detects image density deviations of the plurality of shade portions P1 to P4 of the shade image patterns PY, PK, PM, and PC in the main-scanning direction (width direction). The shade portions P1 to P4 have different image densities that are stepwise different in the sub-scanning direction (conveyance direction). That is to say, the linear sensor 70 optically detects a distribution of image density of each of the shade portions P1 to P4 of each of the colors in the main-scanning direction (width direction).

Figure 9C:
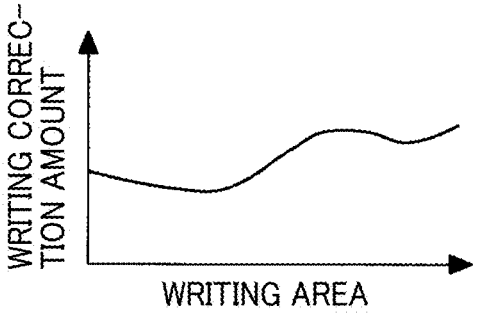

As illustrated in FIG. 9C, on the basis of a detection result of the first detection step, the controller 180 (adjuster) adjusts an image density deviation in the main-scanning direction (width direction).

More specifically, on the basis of a detection result illustrated in FIG. 9B, an image density deviation (image difference) of each of the shade portions P1 to P4 is determined. A writing correction amount is determined across the main-scanning direction (width direction), as illustrated in FIG. 9C, to obtain a set image density (target image density). More specifically, as described above, a light intensity (output) of an exposure light beam emitted onto a surface of a photoconductor is optimized for each of a plurality of areas divided in the main-scanning direction (width direction). Consequently, an exposure potential (latent-image potential) on a surface of the photoconductor is optimized for each of the areas. Consequently, an image density is made more uniform across the main-scanning direction (width direction) than an image density before the adjustment.

However, image density deviation variation in the main-scanning direction (width direction) may not be sufficiently eliminated due to different light intensity sensitivities (that are a degree of variation in an image density relative to variation in an exposure light beam emitted from the exposure device 101) due to a change in apparatus usage circumstances, an apparatus difference, an apparatus deterioration, or the like. Therefore, in the present embodiment, a step described below is added to the "density deviation adjustment mode".

Figure 9D:
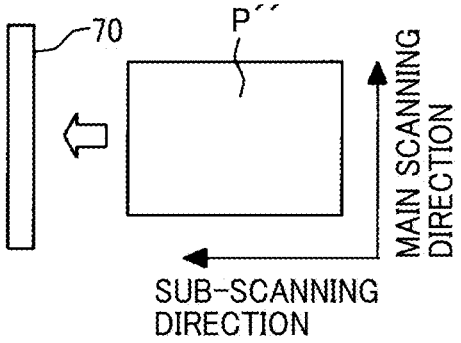

After the adjustment step described with reference to FIG. 9C (after adjustment), the printer engine 100 (image forming device) forms shade image patterns PY, PK, PM, and PC (see FIG. 10) as second image patterns on a surface of a sheet P" (that is different from the sheet P' on which the shade image patterns PY, PK, PM, and PC are formed in FIG. 9A) as an image bearer, as illustrated in FIG. 9D. The step that forms the shade image patterns PY, PK, PM, and PC as second image patterns is similar to the step in FIG. 9A except for reflection of adjustment described with reference to FIG. 9C.

Figure 9E:
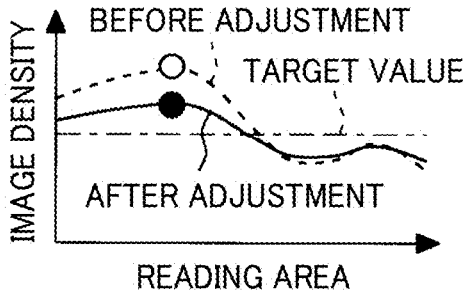
Figure 9E:
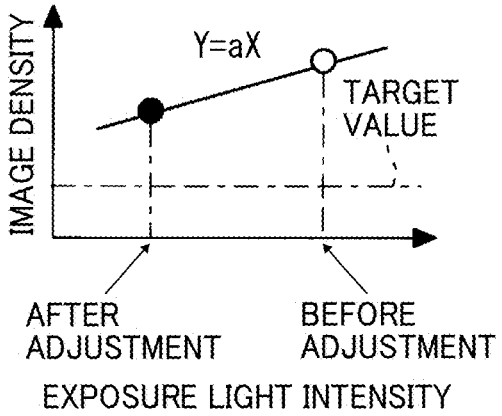

Then the linear sensor 70 (density deviation detector) detects image density deviations in the main-scanning direction (width direction) in the shade image patterns PY, PK, PM, and PC (second image patterns), as illustrated in a left drawing in FIG. 9E (second detection step). That is to say, the linear sensor 70 optically detects a distribution of image density in the main-scanning direction after the adjustment, similarly as a distribution of image density in the main-scanning direction before the adjustment in FIG. 9B.

Figure 9F:
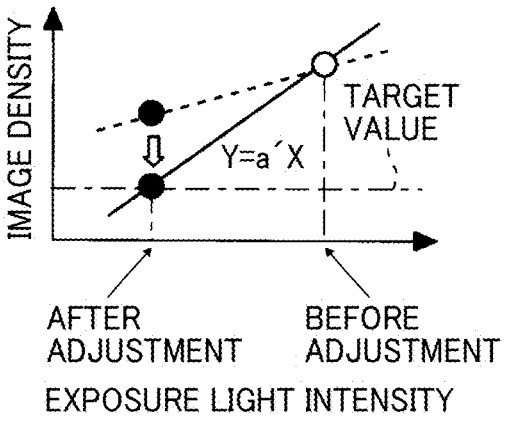
Figure 9G:
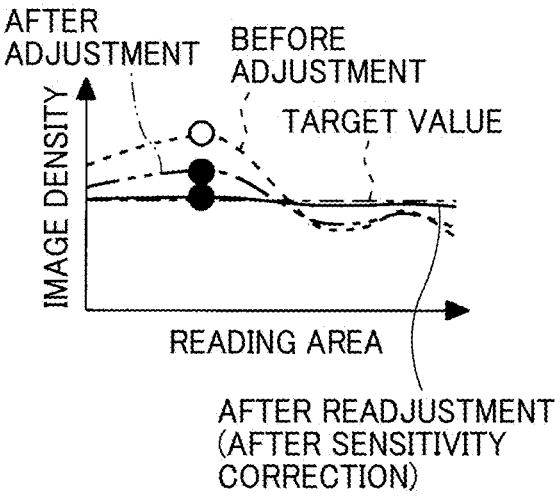

Then, as illustrated in FIGS. 9F and 9G, on the basis of a detection result of the second detection step, a ratio (light intensity sensitivity) at a time when the controller 180 (adjuster) adjusts an image density deviation in the main-scanning direction (width direction) is corrected.

With reference to a right drawing in FIG. 9E, the "light intensity sensitivity (ratio)" (ratio at a time when an adjuster adjusts an image density deviation in the main-scanning direction (width direction) is a light intensity sensitivity for each of areas in the main-scanning direction (width direction). The "light intensity sensitivity (ratio)" is in the form of an inclination a of a straight line obtained from a relationship between variation in light intensity of an exposure light beam and variation in image density. That is to say, from data before and after the adjustment, a relationship expression (straight line: $Y=a\cdot X$) between an exposure light intensity (X) and an image density (Y), as illustrated in the right drawing in FIG. 9E, can be obtained for each of the areas in the main-scanning direction (width direction). The inclination a of the straight line represents a light intensity sensitivity. The light intensity sensitivity (inclination a) varies due to a change in apparatus usage circumstances, an apparatus difference, an apparatus deterioration, or the like. Therefore, even if density deviation adjustments are similarly performed in adjustment steps, results of the density deviation adjustments vary.

As a complete example, in low-temperature and low-humidity circumstances, a charging amount of toner increases. Therefore, a light intensity of an exposure light beam is increased to increase a developing potential to secure an image density. If a light intensity at this time is 100%, and the light intensity is varied by 1%, an image density varies by "one (1/100)".

In high-temperature and high-humidity circumstances, a charging amount of toner decreases. Therefore, a light intensity of an exposure light beam is decreased to decrease a developing potential to obtain an image density that is the same as an image density in low-temperature and low-humidity circumstances. If a light intensity at this time is 50%, and the light intensity is varied by 1%, an image density varies by "two (1/50)".

There is not always a one-to-one correspondence between a light intensity of an exposure light beam and an image density. The above concrete example is completely an example.

Therefore, in the present embodiment, light intensity sensitivity is corrected to allow an image density after adjustment to be a target image density, as illustrated in FIG. 9F (an inclination a is corrected to an inclination a'). That is to say, a relationship expression between exposure light intensity (X) and image density (Y) (straight line: $Y=a'\cdot X$) is corrected to allow an image density (Y) after adjustment to be a target image density.

In other words, "light intensity sensitivity (ratio)" corrected on the basis of a detection result of second image patterns is light intensity sensitivity corrected for each of areas in the main-scanning direction (width direction) to allow an image density in each of the areas to be a target image density.

Therefore, image densities become uniform across the main-scanning direction (width direction), as illustrated in FIG. 9G.

After a density deviation adjustment mode is completed as described above, light intensity sensitivity (relationship expression ($Y=a'\cdot X$)) corrected as described above is used to actuate the exposure device 101 to perform a usual image formation operation (printing).

Variation of usage circumstances has been conventionally controlled with a variation amount of developing gamma (image formation ability). In the present embodiment, variation of usage circumstances is not controlled with a variation amount of developing gamma (image formation ability), as described above, but light intensity sensitivity is updated every time density deviations in the width direction (main-scanning direction) of an image are adjusted.

Especially in the present embodiment, light intensity sensitivity is obtained again every time density deviations in the width direction (main-scanning direction) of an image are adjusted, and correction of density deviations in the width direction (main-scanning direction) is always controlled with new light intensity sensitivity, and toner and sheets P are not wasted.

In the present embodiment, after a density deviation adjustment mode is performed, the controller 180 (adjuster) corrects light intensity sensitivity (ratio), and an image formation operation is performed while the light intensity sensitivity (ratio) remains adjusted. When next one of the density deviation adjustment mode is performed, the light intensity sensitivity (ratio) is updated.

That is to say, every time a density deviation adjustment mode is performed, light intensity sensitivity is updated. The updated light intensity sensitivity is used to perform an image formation operation (printing) until a next density deviation adjustment mode is performed.

Consequently, image density deviations in the main-scanning direction (width direction) are sufficiently decreased even while a time passes.

In the present embodiment, in the density deviation adjustment mode, light intensity sensitivity (ratio) at a time when the controller 180 (adjuster) adjusts an image density deviation in the main-scanning direction (width direction) is corrected for each of different image densities.

That is to say, light intensity sensitivity in each of areas in the main-scanning direction is corrected for each of shades of each of colors, on the basis of shade image patterns PY, PK, PM, and PC of the colors (see FIG. 10).

Consequently, occurrence of image density unevenness in the main-scanning direction (width direction) is decreased irrespective of colors and image densities of a printed image.

As described above, an image formation method performed in the image forming apparatus 1 according to the present embodiment includes characteristic steps described below.

That is to say, the image formation method includes: forming image patterns (shade image patterns PY, PK, PM, and PC) that have image densities that are uniform in the main-scanning direction (width direction) on a surface of an image bearer (sheet P'), as illustrated in FIG. 9A; a first detection step that detects image density deviations in the main-scanning direction (width direction) of the image patterns, as illustrated in FIG. 9B, adjusting the image density deviations in the main-scanning direction (width direction) on the basis of a detection result of the first detection step, as illustrated in FIG. 9C; forming second ones of the image patterns (shade image patterns PY, PK, PM, and PC) on a surface of the image bearer after the adjusting, as illustrated in FIG. 9D; a second detection step that detects image density deviations in the main-scanning direction (width direction) in the second image patterns, as illustrated in FIG. 9E; and on the basis of a detection result of the second detection step, correcting ratio (light intensity sensitivity) at a time when image density deviations in the main-scanning direction (width direction) are adjusted, as illustrated in FIGS. 9F and 9G.

Consequently, the image density deviations in the main-scanning direction (width direction) are more sufficiently decreased than a case where light intensity sensitivity (ratio) is not corrected.

Figure 11:
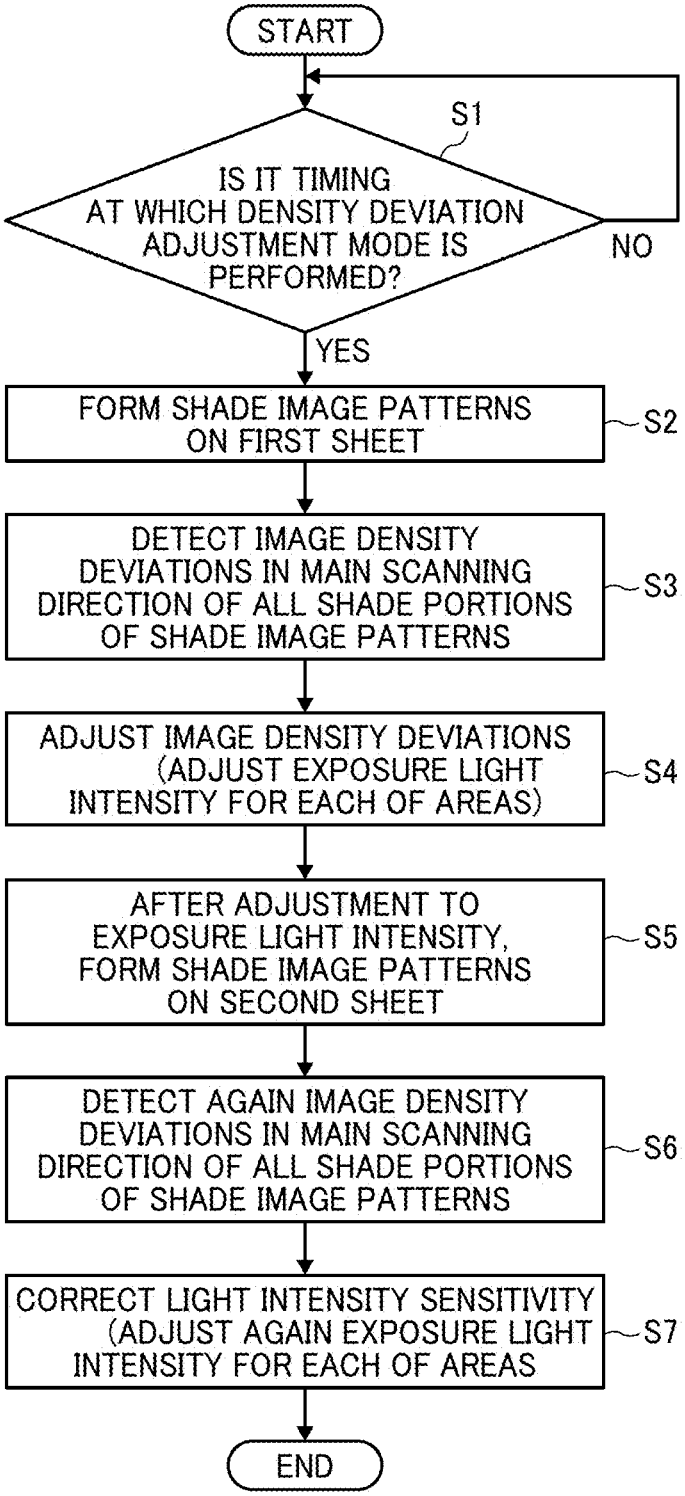
FIG. 11 is a flowchart illustrating control at a time of a density deviation adjustment mode.

FIG. 11 is a flowchart that illustrates control at a time of a density deviation adjustment mode.

As illustrated in FIG. 11, first, it is determined whether or not it is a timing at which a "density deviation adjustment mode" is performed (step S1). If it is determined that it is the timing, a sheet P' (first sheet) on which shade image patterns PY, PK, PM, and PC are formed is conveyed to a position of the linear sensor 70 (step S2). A timing at which a "density deviation adjustment mode" is performed is preliminarily set to, for example, warm-up after the number of accumulated printing reaches a predetermined number. Alternatively, operation by an operator, such as a user, may perform a "density deviation adjustment mode" at any time, as described above with reference to FIG. 8.

Then the linear sensor 70 detects image density deviations in the main-scanning direction of all shade portions P1 to P4 of the shade image patterns PY, PK, PM, and PC (step S3). Then, on the basis of results of the detection, image density deviations are adjusted (step S4). That is to say, an exposure light intensity is adjusted for each of areas.

Then, on the basis of reflection of a result of the adjustment in step S4, another sheet P" (second sheet) on which shade image patterns PY, PK, PM, and PC are formed is conveyed to a position of the linear sensor 70 (step S5). Then the linear sensor 70 detects image density deviations in the main-scanning direction of all shade portions P1 to P4 of the shade image patterns PY, PK, PM, and PC (step S6).

Finally, on the basis of results of the detection, light intensity sensitivity is corrected (step S7). That is to say, an exposure light intensity is adjusted again for each of the areas. As described above, a series of the density deviation adjustment mode is completed.

As described above, the image forming apparatus 1 according to the present embodiment includes: the printer engine 100 (image forming device) that forms an image on a surface of a sheet P (image bearer) conveyed in a predetermined conveyance direction; the linear sensor 70 (density deviation detector) that detects image density deviations in the main-scanning direction (width direction perpendicular to the conveyance direction of the sheet P) in the image on the surface of the sheet P; and the controller 180 (adjuster) that adjusts image density deviations in the main-scanning direction (width direction) in an image formed by the printer engine 100. The printer engine 100 forms shade image patterns PY, PK, PM, and PC (image patterns) that have image densities that are uniform in the main-scanning direction (width direction) on a surface of a sheet P. The linear sensor 70 detects image density deviations in the main-scanning direction (width direction) in the shade image patterns PY, PK, PM, and PC. On the basis of a result of the detection, the controller 180 adjusts the image density deviations in the main-scanning direction (width direction). After the adjustment, the printer engine 100 forms shade image patterns PY, PK, PM, and PC (second ones of the image patterns) on a surface of a sheet P. The linear sensor 70 detects image density deviations in the main-scanning direction (width direction) in the shade image patterns PY, PK, PM, and PC (second image patterns). On the basis of a result of the detection, a "density deviation adjustment mode" is performed. The "density deviation adjustment mode" corrects light intensity sensitivity (ratio) at a time when the controller 180 adjusts image density deviations in the main-scanning direction (width direction).

Consequently, the image density deviations in the main-scanning direction (width direction) are sufficiently decreased.

In the present embodiment, the linear sensor 70 (density deviation detector) is disposed downstream of the fixing device 104. However, a position of the linear sensor 70 is not limited to the position. The linear sensor 70 can be disposed in a conveyance path through which a sheet P that has passed the image forming device (a sheet P' on which an image pattern has been formed) is conveyed.

In the present embodiment, shade image patterns are formed on a sheet P as an image bearer, and the linear sensor 70 (density deviation detector) detects density deviations of the shade image patterns on the sheet P. However, an image bearer on which shade image patterns are formed is not limited to a sheet. For example, shade image patterns may be formed on the intermediate transfer belt 130 as an image bearer. A density deviation detector disposed opposite the intermediate transfer belt 130 may detect density deviations of the shade image patterns on the intermediate transfer belt 130.

In the present embodiment, the present disclosure is applied to the image forming apparatus 1 that includes the four-color photoconductors that are opposite the intermediate transfer belt 130 and align in order of cyan (C), magenta (M), black (K), and yellow (Y) from an upstream side. Alignment of the photoconductors is not limited to the alignment. For example, the present disclosure can be naturally applied to an image forming apparatus that includes four-color photoconductors that align in order of yellow (Y), magenta (M), cyan (C), and black (K) from an upstream side.

Such cases also provide substantially the same effects as the effects described above.

The present disclosure is not limited to the above-described embodiment and variations, and the configuration of the present embodiment can be appropriately modified other than suggested in the above embodiment and variations within a scope of the technological concept of the present disclosure. Further, the number, position, shape, and so forth of components are not limited to those of the present embodiment, and may be the number, position, shape, and so forth that are suitable for implementing the present disclosure.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image forming device configured to form an image on a surface of an image bearer conveyed in a conveyance direction;

a density deviation detector configured to detect an image density deviation in a width direction perpendicular to the conveyance direction in the image on the surface of the image bearer; and processing circuitry configured to adjust an image density deviation in the width direction in an image formed by the image forming device, wherein the processing circuitry is configured to perform a density deviation adjustment mode to:

cause the image forming device to form a first image pattern having a uniform image density in the width direction on a surface of the image bearer;

cause the density deviation detector to detect a first image density deviation in the width direction in the first image pattern;

adjust the first image density deviation in the width direction, based on a detection result of the first image pattern;

cause the image forming device to form a second image pattern on a surface of the image bearer after adjustment of the first image density deviation;

cause the density deviation detector to detect a second image density deviation in the width direction in the second image pattern; and correct a light intensity sensitivity in adjusting the second image density deviation in the width direction, based on a detection result of the second image pattern.

2. The image forming apparatus according to claim 1, wherein the image forming device includes:

a photoconductor configured to rotate in a predetermined direction; and an exposure device configured to irradiate a surface of the photoconductor with an exposure light beam across the width direction to form a latent image of an image to be formed, and wherein the processing circuitry is configured to adjust a light intensity of the exposure light beam emitted from the exposure device, for each of a plurality of areas divided in the width direction.

3. The image forming apparatus according to claim 2, wherein the light intensity sensitivity in adjusting the second image density deviation in the width direction is a light intensity sensitivity for each of the plurality of areas, wherein the light intensity sensitivity is expressed in a form of an inclination of a straight line obtained from a relationship between variation in the light intensity of the exposure light beam and variation in image density of the second image pattern, and wherein the processing circuitry is configured to the light intensity sensitivity for each of the plurality of areas, based on the detection result of the second image pattern so that an image density in each of the plurality of areas is equal to a target image density.

4. The image forming apparatus according to claim 1, wherein the image bearer is a sheet, and a sheet on which the second image pattern is formed is different from a sheet on which the first image pattern is formed, and wherein the density deviation detector includes a linear sensor disposed in a conveyance path through which a sheet that has passed the image forming device is conveyed, and the linear sensor extends in the width direction and is configured to oppose the sheet on the conveyance path.

5. The image forming apparatus according to claim 1, wherein the processing circuitry is configured to:

after performing the density deviation adjustment mode, cause the image forming device to perform an image formation operation with the light intensity sensitivity corrected; and update the light intensity sensitivity corrected, in performing the density deviation adjustment mode next time.

6. The image forming apparatus according to claim 1, wherein the second image pattern includes a shade image pattern that has a uniform image density in the width direction and different image densities that are stepwisely different in the conveyance direction, and wherein the processing circuitry is configured to perform the density deviation adjustment mode to correct the light intensity sensitivity in adjusting the second image density deviation in the width direction, for each of the different image densities.

7. An image formation method comprising:

forming a first image pattern having a uniform image density in a width direction;

first detecting a first image density deviation in the width direction in the first image pattern;

adjusting the first image density deviation in the width direction based on a detection result of the first detecting;

forming a second image pattern having a uniform image density in the width direction;

second detecting a second image density deviation in the width direction in the second image pattern; and correcting a light intensity sensitivity in adjusting the second image density deviation in the width direction, based on a detection result of the second detecting.

* * * * *